US007167129B1

(12) United States Patent
Strassner, II

(10) Patent No.: US 7,167,129 B1
(45) Date of Patent: Jan. 23, 2007

(54) REPRODUCIBLE, HIGH PERFORMANCE PATCH ANTENNA ARRAY APPARATUS AND METHOD OF FABRICATION

(75) Inventor: Bernd H. Strassner, II, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 10/963,162

(22) Filed: Oct. 12, 2004

(51) Int. Cl.
*H01Q 1/38* (2006.01)
*H01Q 21/00* (2006.01)

(52) U.S. Cl. ..... 343/700 MS; 343/824

(58) Field of Classification Search ..... 343/700 MS, 343/824, 826, 850, 893
See application file for complete search history.

(56) References Cited

U.S. PATENT DOCUMENTS 5,455,594 A * 10/1995 Blasing et al. ..... 343/700 MS
5,510,803 A * 4/1996 Ishizaka et al. ..... 343/700 MS
5,877,592 A * 3/1999 Hesterman et al. ..... 315/106
6,269,015 B1 * 7/2001 Ikeda et al. ..... 363/142
6,292,133 B1 * 9/2001 Lynch ..... 342/368
6,388,624 B1 * 5/2002 Kazumi et al. ..... 343/701

OTHER PUBLICATIONS

C. Kidder and K. Chang, "Broad-Band U-Slot Patch Antenna With a Proximity-Coupled Double II-Shaped Feed Line for Arrays," IEEE Antennas and Wireless Propagation Letters, vol. 1, No. 1, pp. 2-4, 2002.
D. H. Schaubert, "Wide-Band Phased Arrays of Vivaldi Notch Antennas," 10th International Conference on Antennas and Propagation, No. 436, Apr. 14-17, 1997.
M. Edimo, P. Rigoland, and C. Terret, "Wideband dual polarized aperture-coupled stacked patch antenna array operating in C-band," Electronic Letters, vol. 30, No. 15, pp. 1196-1198, Jul. 21, 1994.
L. I. Parad and R. L. Moynihan, "Split-Tee Power Divider," IEEE Trans. on Microwave Theory and Tech, vol. 13, No. 1, pp. 91-95, Jan. 1965.

* cited by examiner

*Primary Examiner*—Tuyet Vo
*Assistant Examiner*—Minh Dieu A
(74) *Attorney, Agent, or Firm*—Elmer A. Klavetter

(57) ABSTRACT

A reproducible, high-performance patch antenna array apparatus includes a patch antenna array provided on a unitary dielectric substrate, and a feed network provided on the same unitary substrate and proximity coupled to the patch antenna array. The reproducibility is enhanced by using photolithographic patterning and etching to produce both the patch antenna array and the feed network.

8 Claims, 9 Drawing Sheets

FIG. 7

| | | | | | | | | | | | | | | | |
|---|---|---|---|---|---|---|---|---|---|---|---|---|---|---|---|
| 0.0323 | 0.0323 | 0.0576 | 0.0576 | 0.0932 | 0.0932 | 0.1344 | 0.1344 | 0.1755 | 0.1755 | 0.2111 | 0.2111 | 0.2364 | 0.2364 | 0.2478 | 0.2478 |
| 0.0323 | 0.0323 | 0.0576 | 0.0576 | 0.0932 | 0.0932 | 0.1344 | 0.1344 | 0.1755 | 0.1755 | 0.2111 | 0.2111 | 0.2364 | 0.2364 | 0.2478 | 0.2478 |
| 0.0702 | 0.0702 | 0.1250 | 0.1250 | 0.2023 | 0.2023 | 0.2916 | 0.2916 | 0.3809 | 0.3809 | 0.4582 | 0.4582 | 0.5130 | 0.5130 | 0.5379 | 0.5379 |
| 0.0702 | 0.0702 | 0.1250 | 0.1250 | 0.2023 | 0.2023 | 0.2916 | 0.2916 | 0.3809 | 0.3809 | 0.4582 | 0.4582 | 0.5130 | 0.5130 | 0.5379 | 0.5379 |
| 0.1080 | 0.1080 | 0.1924 | 0.1924 | 0.3113 | 0.3113 | 0.4488 | 0.4488 | 0.5864 | 0.5864 | 0.7053 | 0.7053 | 0.7896 | 0.7896 | 0.8279 | 0.8279 |
| 0.1080 | 0.1080 | 0.1924 | 0.1924 | 0.3113 | 0.3113 | 0.4488 | 0.4488 | 0.5864 | 0.5864 | 0.7053 | 0.7053 | 0.7896 | 0.7896 | 0.8279 | 0.8279 |
| 0.1282 | 0.1282 | 0.2282 | 0.2282 | 0.3693 | 0.3693 | 0.5325 | 0.5325 | 0.6957 | 0.6957 | 0.8368 | 0.8368 | 0.9368 | 0.9368 | 0.9823 | 0.9823 |
| 0.1282 | 0.1282 | 0.2282 | 0.2282 | 0.3693 | 0.3693 | 0.5325 | 0.5325 | 0.6957 | 0.6957 | 0.8368 | 0.8368 | 0.9368 | 0.9368 | 0.9823 | 0.9823 |
| 0.1282 | 0.1282 | 0.2282 | 0.2282 | 0.3693 | 0.3693 | 0.5325 | 0.5325 | 0.6957 | 0.6957 | 0.8368 | 0.8368 | 0.9368 | 0.9368 | 0.9823 | 0.9823 |
| 0.1282 | 0.1282 | 0.2282 | 0.2282 | 0.3693 | 0.3693 | 0.5325 | 0.5325 | 0.6957 | 0.6957 | 0.8368 | 0.8368 | 0.9368 | 0.9368 | 0.9823 | 0.9823 |
| 0.1080 | 0.1080 | 0.1924 | 0.1924 | 0.3113 | 0.3113 | 0.4488 | 0.4488 | 0.5864 | 0.5864 | 0.7053 | 0.7053 | 0.7896 | 0.7896 | 0.8279 | 0.8279 |
| 0.1080 | 0.1080 | 0.1924 | 0.1924 | 0.3113 | 0.3113 | 0.4488 | 0.4488 | 0.5864 | 0.5864 | 0.7053 | 0.7053 | 0.7896 | 0.7896 | 0.8279 | 0.8279 |
| 0.0702 | 0.0702 | 0.1250 | 0.1250 | 0.2023 | 0.2023 | 0.2916 | 0.2916 | 0.3809 | 0.3809 | 0.4582 | 0.4582 | 0.5130 | 0.5130 | 0.5379 | 0.5379 |
| 0.0702 | 0.0702 | 0.1250 | 0.1250 | 0.2023 | 0.2023 | 0.2916 | 0.2916 | 0.3809 | 0.3809 | 0.4582 | 0.4582 | 0.5130 | 0.5130 | 0.5379 | 0.5379 |
| 0.0323 | 0.0323 | 0.0576 | 0.0576 | 0.0932 | 0.0932 | 0.1344 | 0.1344 | 0.1755 | 0.1755 | 0.2111 | 0.2111 | 0.2364 | 0.2364 | 0.2478 | 0.2478 |
| 0.0323 | 0.0323 | 0.0576 | 0.0576 | 0.0932 | 0.0932 | 0.1344 | 0.1344 | 0.1755 | 0.1755 | 0.2111 | 0.2111 | 0.2364 | 0.2364 | 0.2478 | 0.2478 |

41

FIG. 8

41

| | | | | | | | | | | | | | | | |
|---|---|---|---|---|---|---|---|---|---|---|---|---|---|---|---|
| 0.2478 | 0.2478 | 0.2364 | 0.2364 | 0.2111 | 0.2111 | 0.1755 | 0.1755 | 0.1344 | 0.1344 | 0.0932 | 0.0932 | 0.0576 | 0.0576 | 0.0323 | 0.0323 |
| 0.2478 | 0.2478 | 0.2364 | 0.2364 | 0.2111 | 0.2111 | 0.1755 | 0.1755 | 0.1344 | 0.1344 | 0.0932 | 0.0932 | 0.0576 | 0.0576 | 0.0323 | 0.0323 |
| 0.5379 | 0.5379 | 0.5130 | 0.5130 | 0.4582 | 0.4582 | 0.3809 | 0.3809 | 0.2916 | 0.2916 | 0.2023 | 0.2023 | 0.1250 | 0.1250 | 0.0702 | 0.0702 |
| 0.5379 | 0.5379 | 0.5130 | 0.5130 | 0.4582 | 0.4582 | 0.3809 | 0.3809 | 0.2916 | 0.2916 | 0.2023 | 0.2023 | 0.1250 | 0.1250 | 0.0702 | 0.0702 |
| 0.8279 | 0.8279 | 0.7896 | 0.7896 | 0.7053 | 0.7053 | 0.5864 | 0.5864 | 0.4488 | 0.4488 | 0.3113 | 0.3113 | 0.1924 | 0.1924 | 0.1080 | 0.1080 |
| 0.8279 | 0.8279 | 0.7896 | 0.7896 | 0.7053 | 0.7053 | 0.5864 | 0.5864 | 0.4488 | 0.4488 | 0.3113 | 0.3113 | 0.1924 | 0.1924 | 0.1080 | 0.1080 |
| 0.9823 | 0.9823 | 0.9368 | 0.9368 | 0.8368 | 0.8368 | 0.6957 | 0.6957 | 0.5325 | 0.5325 | 0.3693 | 0.3693 | 0.2282 | 0.2282 | 0.1282 | 0.1282 |
| 0.9823 | 0.9823 | 0.9368 | 0.9368 | 0.8368 | 0.8368 | 0.6957 | 0.6957 | 0.5325 | 0.5325 | 0.3693 | 0.3693 | 0.2282 | 0.2282 | 0.1282 | 0.1282 |
| 0.9823 | 0.9823 | 0.9368 | 0.9368 | 0.8368 | 0.8368 | 0.6957 | 0.6957 | 0.5325 | 0.5325 | 0.3693 | 0.3693 | 0.2282 | 0.2282 | 0.1282 | 0.1282 |
| 0.9823 | 0.9823 | 0.9368 | 0.9368 | 0.8368 | 0.8368 | 0.6957 | 0.6957 | 0.5325 | 0.5325 | 0.3693 | 0.3693 | 0.2282 | 0.2282 | 0.1282 | 0.1282 |
| 0.8279 | 0.8279 | 0.7896 | 0.7896 | 0.7053 | 0.7053 | 0.5864 | 0.5864 | 0.4488 | 0.4488 | 0.3113 | 0.3113 | 0.1924 | 0.1924 | 0.1080 | 0.1080 |
| 0.8279 | 0.8279 | 0.7896 | 0.7896 | 0.7053 | 0.7053 | 0.5864 | 0.5864 | 0.4488 | 0.4488 | 0.3113 | 0.3113 | 0.1924 | 0.1924 | 0.1080 | 0.1080 |
| 0.5379 | 0.5379 | 0.5130 | 0.5130 | 0.4582 | 0.4582 | 0.3809 | 0.3809 | 0.2916 | 0.2916 | 0.2023 | 0.2023 | 0.1250 | 0.1250 | 0.0702 | 0.0702 |
| 0.5379 | 0.5379 | 0.5130 | 0.5130 | 0.4582 | 0.4582 | 0.3809 | 0.3809 | 0.2916 | 0.2916 | 0.2023 | 0.2023 | 0.1250 | 0.1250 | 0.0702 | 0.0702 |
| 0.2478 | 0.2478 | 0.2364 | 0.2364 | 0.2111 | 0.2111 | 0.1755 | 0.1755 | 0.1344 | 0.1344 | 0.0932 | 0.0932 | 0.0576 | 0.0576 | 0.0323 | 0.0323 |
| 0.2478 | 0.2478 | 0.2364 | 0.2364 | 0.2111 | 0.2111 | 0.1755 | 0.1755 | 0.1344 | 0.1344 | 0.0932 | 0.0932 | 0.0576 | 0.0576 | 0.0323 | 0.0323 |

REPRODUCIBLE, HIGH PERFORMANCE PATCH ANTENNA ARRAY APPARATUS AND METHOD OF FABRICATION

This invention was developed under Contract DE-AC04-94AL8500 between Sandia Corporation and the U.S. Department of Energy. The U.S. Government has certain rights in this invention.

FIELD OF THE INVENTION

The invention relates generally to synthetic aperture radar antennas and, more particularly, to patch antenna arrays for synthetic aperture radar.

BACKGROUND OF THE INVENTION

The five documents listed below are incorporated herein by reference:

[1] C. Kidder and K. Chang, "Broad-Band U-Slot Patch Antenna With a Proximity-Coupled Double Π-Shaped Feed Line for Arrays," *IEEE Antennas and Wireless Propagation Letters*, vol. 1, no. 1, pp. 2–4, 2002.

[2] D. H. Schaubert, "Wide-Band Phased Arrays of Vivaldi Notch Antennas," 10th *International Conference on Antennas and Propagation*, no. 436, Apr. 14–17, 1997.

[3] W. R. Deal, N. Kaneda, J. Sor, Y. Qian, and T. Itoh, "A New Quasi-Yagi Antenna for Planar Active Antenna Arrays," *IEEE Trans. on Microwave Theory and Tech.*, vol. 48, no. 6, pp. 910–918, June 2000.

[4] M. Edimo, P. Rigoland, and C. Terret, "Wideband dual polarized aperture-coupled stacked patch antenna array operating in C-band," *Electronic Letters*, vol. 30, no. 15, pp. 1196–1198, Jul. 21, 1994

[5] L. I. Parad and R. L. Moynihan, "Split-Tee Power Divider," *IEEE Trans. on Microwave Theory and Tech*, vol. 13, no 1, pp. 91–95, January 1965.

Many next-generation synthetic aperture radar (SAR) imaging applications require a substantial reduction in size, weight and cost. Examples of such applications include tactical UAV-based reconnaissance and all-weather, GPS-denied precision weapon guidance. In addition to the aforementioned size, weight and cost restrictions, applications such as these also demand high performance to support extended capabilities, such as ground moving target identification (GMTI).

Conventional high resolution SARs typically employ off-set-fed reflector antennas due to the wide signal bandwidth required. In such systems, the gimbal payload capacity is primarily dictated by the reflector's weight, and the radome size is largely controlled by the feed's swept path. The resulting full antenna assembly has typically been too large and heavy for next-generation applications such as those mentioned above.

Some conventional antenna construction techniques utilize photolithographic patterning and corresponding etching, which is a relatively simple and inexpensive process. Typical examples of etched antennas include Vivaldi and Yagi antennas. These antennas are constructed in three dimensions, and therefore occupy a relatively large volume.

On the other hand, patch antenna arrays are advantageously planar, which permits relatively easy fabrication of relatively small antenna arrays. Some conventional patch antenna arrays utilize U-shaped patches in conjunction with multiple proximity-coupled feeding points. Such patch antenna arrays can provide a relatively broad bandwidth capability, but do not tend to be easily reproducible.

It is desirable in view of the foregoing to provide a patch antenna array apparatus which can meet the performance requirements of next-generation applications, and which is more easily reproducible than prior art patch antenna arrays.

Exemplary embodiments of the present invention provide a patch antenna array apparatus wherein the patch antenna array and the feed network are provided together on a common substrate, thereby enhancing the reproducibility of the coupling therebetween.

BRIEF DESCRIPTION OF THE DRAWINGS

FIGS. 7 and 8, taken together, illustrate amplitude weights implemented by exemplary embodiments of the tapered feed network of FIG. 5.

DETAILED DESCRIPTION

Figure 1:
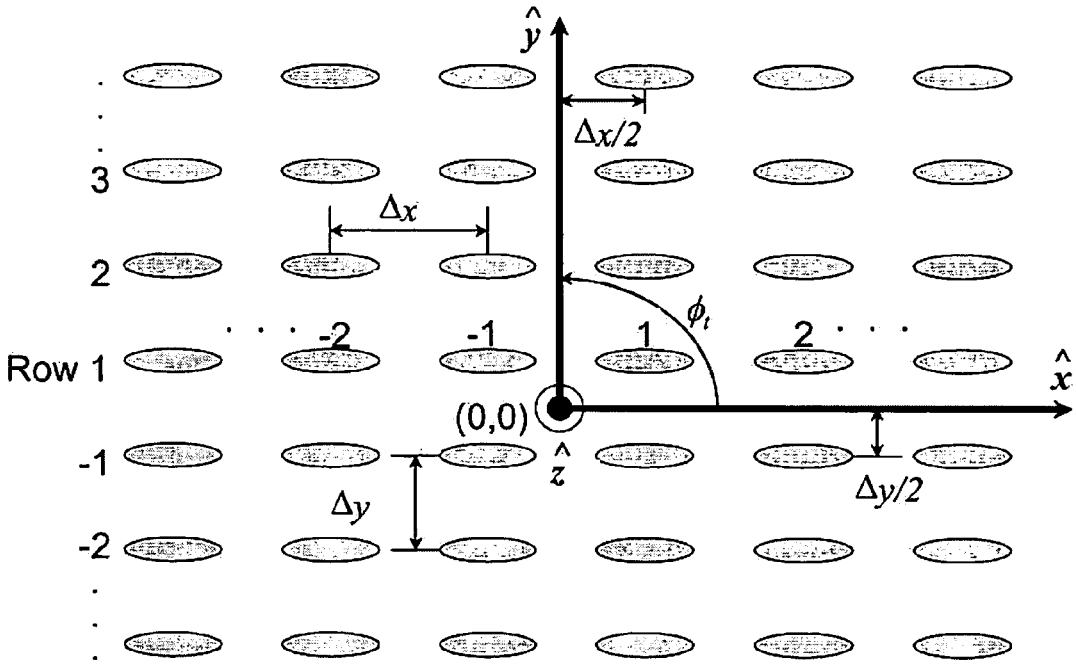
FIG. 1 graphically illustrates the array geometry associated with exemplary embodiments of a patch antenna array according to the invention.

FIG. 1 graphically illustrates a two-dimensional antenna array geometry containing m columns and n rows according to exemplary embodiments of the invention. The m×n array of FIG. 1 has m=2M columns and n=2N rows, where M and N are integers. One way to achieve low side-lobes is to apply a "Hamming" weighting to taper the array's aperture. Each u,v element in the array receives power based on the amplitude weighting given by $$A_{u,v} = \left[\frac{27}{50} + \frac{23}{50}\cos\left(\frac{\left(\frac{2u-(2M+1)}{2}\right)-\frac{1}{2}}{M+1}\pi\right)\right]\left[\frac{27}{50} + \frac{23}{50}\cos\left(\frac{\left(\frac{2v-(2N+1)}{2}\right)-\frac{1}{2}}{N+1}\pi\right)\right] \quad \begin{matrix} u = 1, 2, \ldots, m \\ v = 1, 2, \ldots, n \end{matrix} \tag{1}$$

where the subscript u pertains to the uth element in $\hat{x}$ and v identifies the vth element in $\hat{y}$. This applied aperture taper can lower the side-lobes to more than 30 dB below the main beam peak so that power is not radiated in undesirable directions. This can become a concern in applications wherein a large amount of power is transmitted. If no taper is applied to the transmitting aperture, i.e. the array has uniform weighting, the worst case side-lobes can be expected to be around 12.5 dB below the peak gain of the radiation pattern.

The array factor of the transmitting antenna array geometry of FIG. 1 is defined as $$AF = \sum_{u=1}^{m}\sum_{v=1}^{n} A_{u,v} e^{j\left(\left(\frac{2u-(2M-1)}{2}\right)-1\right)(k\Delta x \sin\theta_t \cos\phi_t+\beta_x)} e^{j\left(\left(\frac{2v-(2N-1)}{2}\right)-1\right)(k\Delta y \sin\theta_t \cos\phi_t+\beta_y)} \quad (2)$$

where $k=2\pi/\lambda_0$, and $\Delta x$ and $\Delta y$ are the element spacings in the $\hat{x}$ and $\hat{y}$ directions of FIG. 1. The elevation angle $\theta_t$ is the angle measured from the $\hat{z}$ axis towards the $\hat{x}$-$\hat{y}$ plane, and the azimuth angle $\phi_t$ is measured from the $\hat{x}$ axis towards the $\hat{y}$ axis. $\beta_x$ and $\beta_y$ represent the progressive phase shift in the $\hat{x}$ and $\hat{y}$ directions, respectively for steering the beam. The array elements in FIG. 1 are spaced approximately $\lambda_0/2$ from each other in both $\hat{x}$ and $\hat{y}$ directions to avoid harmful gradient lobes. The wavelength $\lambda_0$ is obtained by dividing the speed of light by the operating frequency.

The aforementioned aperture tapering for side-lobe reduction lowers antenna radiation efficiency and broadens the main beam of the array's radiation pattern. The efficiency reduction is caused simply by the fact that the outer elements of the array are contributing little to the radiated power. Some of the antenna array's elements positioned furthest from the array's center radiate very little, especially in large arrays, but these remotely-positioned elements still contribute to side-lobe reduction.

Figure 2:
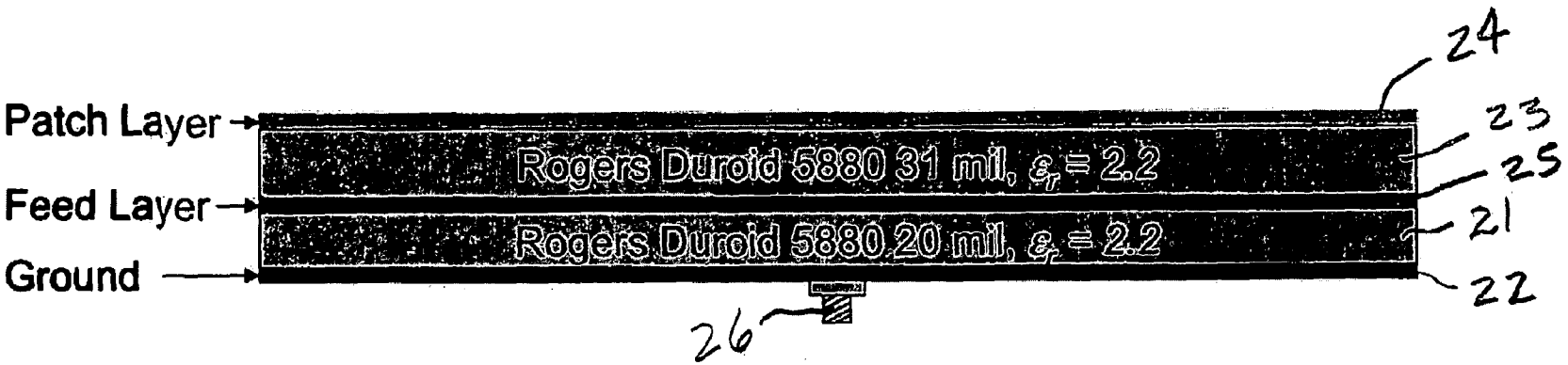
FIG. 2 is a side view of a multi-layer structure associated with exemplary embodiments of a patch antenna array apparatus according to the invention.

FIG. 2 is a diagrammatic side view of a patch antenna array apparatus according to exemplary embodiments of the invention. The patch antenna array apparatus of FIG. 2 includes two dielectric substrates 21 and 23, each of which is a unitary structure. In some embodiments, the two dielectric substrates have a common dielectric constant, for example, the dielectric constant of 2.2 illustrated in FIG. 2. In some embodiments, the dielectric substrates are Teflon sheets, for example the Duroid 5880 sheets illustrated in FIG. 2. The two dielectric substrates 21 and 23 are laminated together as shown in FIG. 2 to form a generally planar patch antenna array structure. The dielectric substrate 21 has on one side thereof an electrically conductive material 22, for example, copper plating. The dielectric substrate 23 has on both oppositely facing sides thereof an electrically conductive material, for example, copper plating. Conventional photolithographic and etching techniques can be used to pattern and etch the desired patch antenna array structure into the electrically conductive plating on one side of the substrate 23, and to pattern and etch the desired feed network structure into the electrically conductive plating on the opposite side of the substrate 23. Thus, the etched antenna array structure 24 is located in the patch layer of FIG. 2, and the etched feed network structure 25 is located in the feed layer of FIG. 2.

The feed network side of the substrate 23 is then laminated onto the substrate 21 opposite the electrically conductive material 22, which material 22 serves as the antenna ground plane. In some embodiments, the substrates 21 and 23 are bonded together with a thin layer of Arlon (Teflon) which melts when heated. In some embodiments, the two substrates 21 and 23 are pressed together in the stacked orientation shown in FIG. 2, with the Arlon layer interposed therebetween. The Arlon is then heated to 450 degrees Fahrenheit for 30 minutes. This melts the Arlon and bonds the pressed substrates 21 and 23 together to form the generally planar multi-layer, or laminate, patch antenna array apparatus. In some embodiments, a single conventional SMA connector 26 is soldered onto the ground plane 22 with its outer conductor electrically contacting the ground plane 22. The inner conductor of the SMA connector 26 is isolated from the ground plane 22. The inner conductor extends through an opening in the substrate 21 (not shown) and is electrically connected to the feed network 25.

Figure 9:
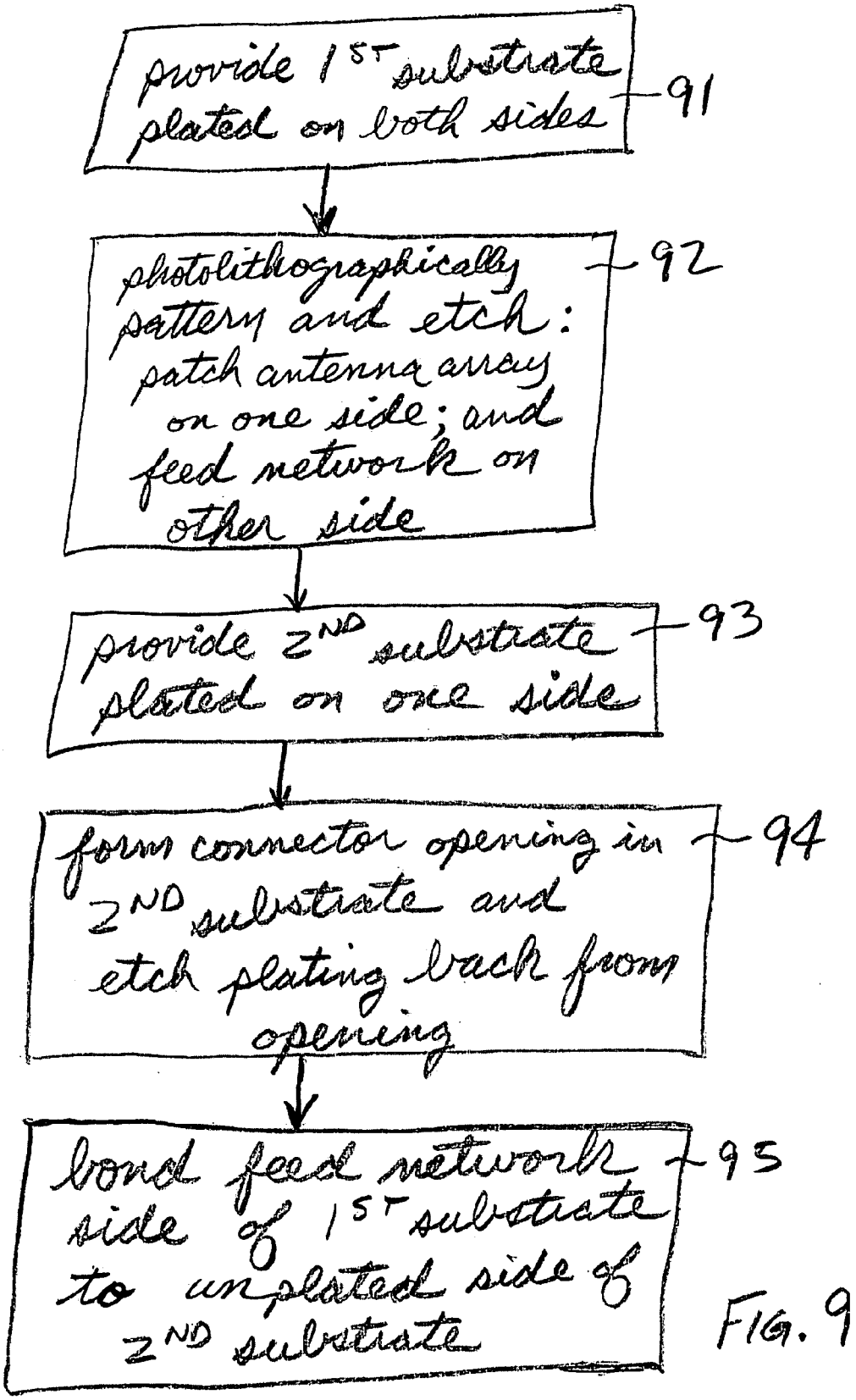
FIG. 9 illustrates exemplary operations which can be performed to fabricate a patch antenna array apparatus according to exemplary embodiments of the invention.

FIG. 9 generally illustrates the above-described operations used in fabricating exemplary embodiments of the patch antenna array apparatus of FIG. 2. At 91, the first dielectric substrate is provided with conductive plating on both sides thereof. At 92, the desired patch antenna array is photolithographically patterned and etched into the conductive plating on one side of the first substrate, and the desired feed network is photolithographically patterned and etched into the conductive plating on the opposite side of the first substrate. At 93, the second substrate is provided with one side plated with electrically conductive material and the other side unplated. At 94, the connector opening is formed through the second substrate, and the plating is etched back sufficiently from the opening to insure that the inner conductor of the SMA connector (and thus the feed network) is isolated from the plating (i.e., from the ground plane). At 95, the feed network side of the first substrate is bonded to the unplated side of the second substrate.

Figure 3:
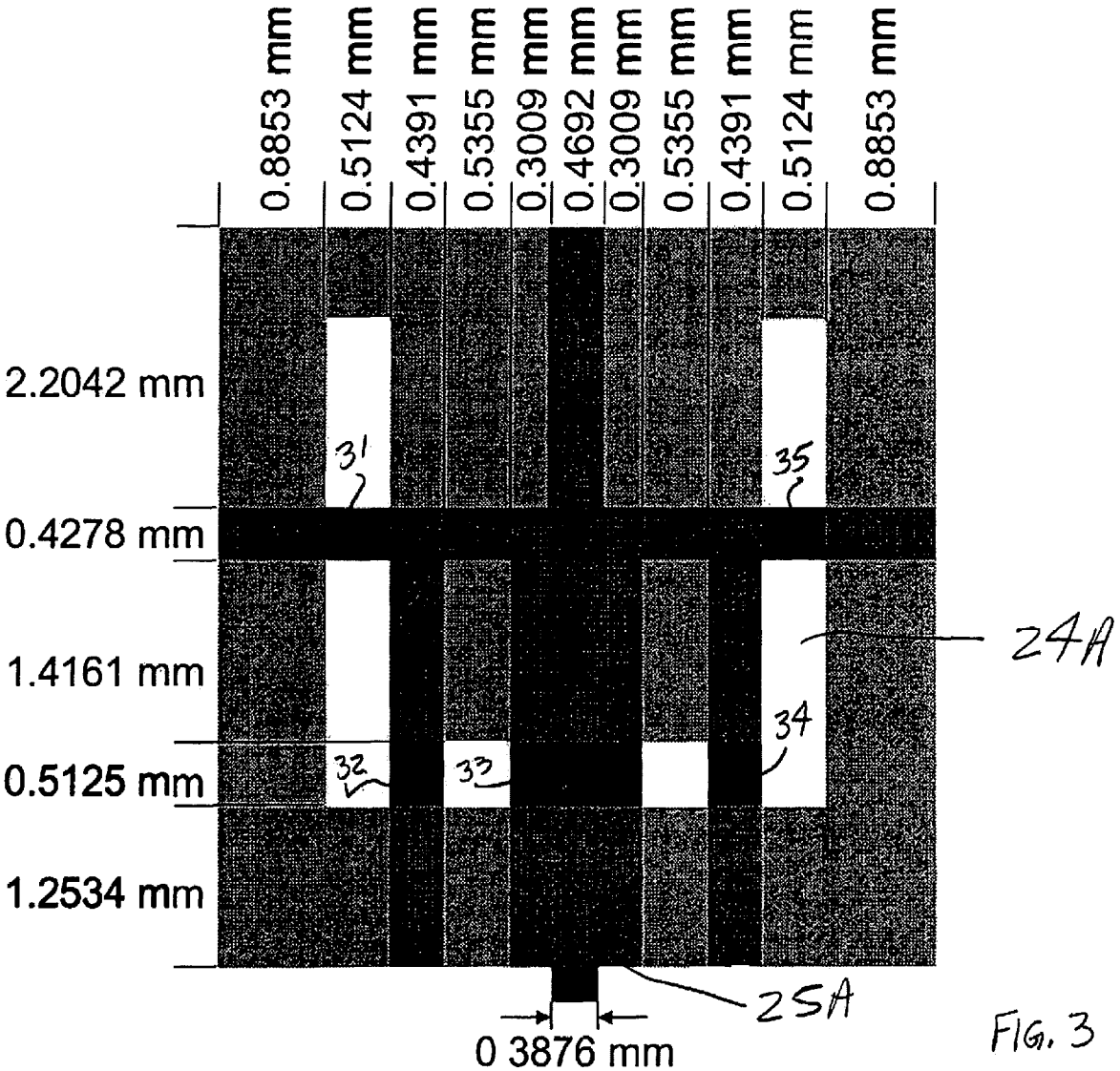
FIG. 3 illustrates the spatial relationship and corresponding proximity coupling between the feed network in the feed layer of FIG. 2 and a patch antenna in the patch layer of FIG. 2 according to exemplary embodiments of the invention.

FIG. 3 illustrates the spatial relationship and corresponding proximity coupling between one of the patch antennas 24A of the patch antenna array 24, and the associated portion 25A of the feed network 25, according to exemplary embodiments of the invention. As shown in the example of FIG. 3, the patch antenna 24A has generally a U-shape which overlies the corresponding feed network portion 25A to create five generally stub-shaped proximity coupling points 31–35. This provides multiple proximity coupling between the feed network portion 25A and the patch antenna 24A. FIG. 3 also shows various dimensions of the patch antenna 24A and the feed network portion 25A according to an exemplary embodiment.

Figure 4:
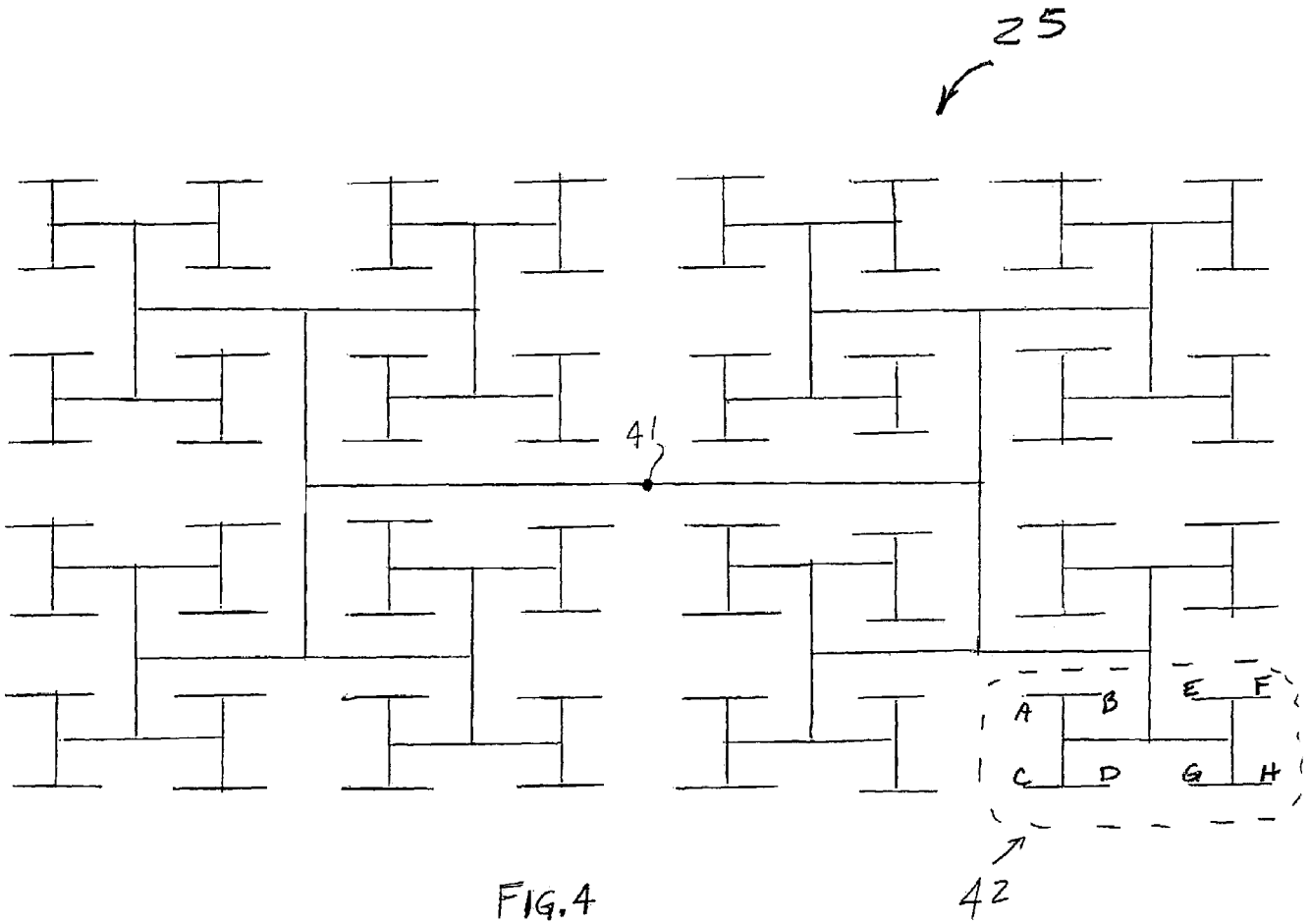
FIG. 4 diagrammatically illustrates exemplary embodiments of a feed network in the feed layer of FIG. 2 according to exemplary embodiments of the invention.
Figure 6:
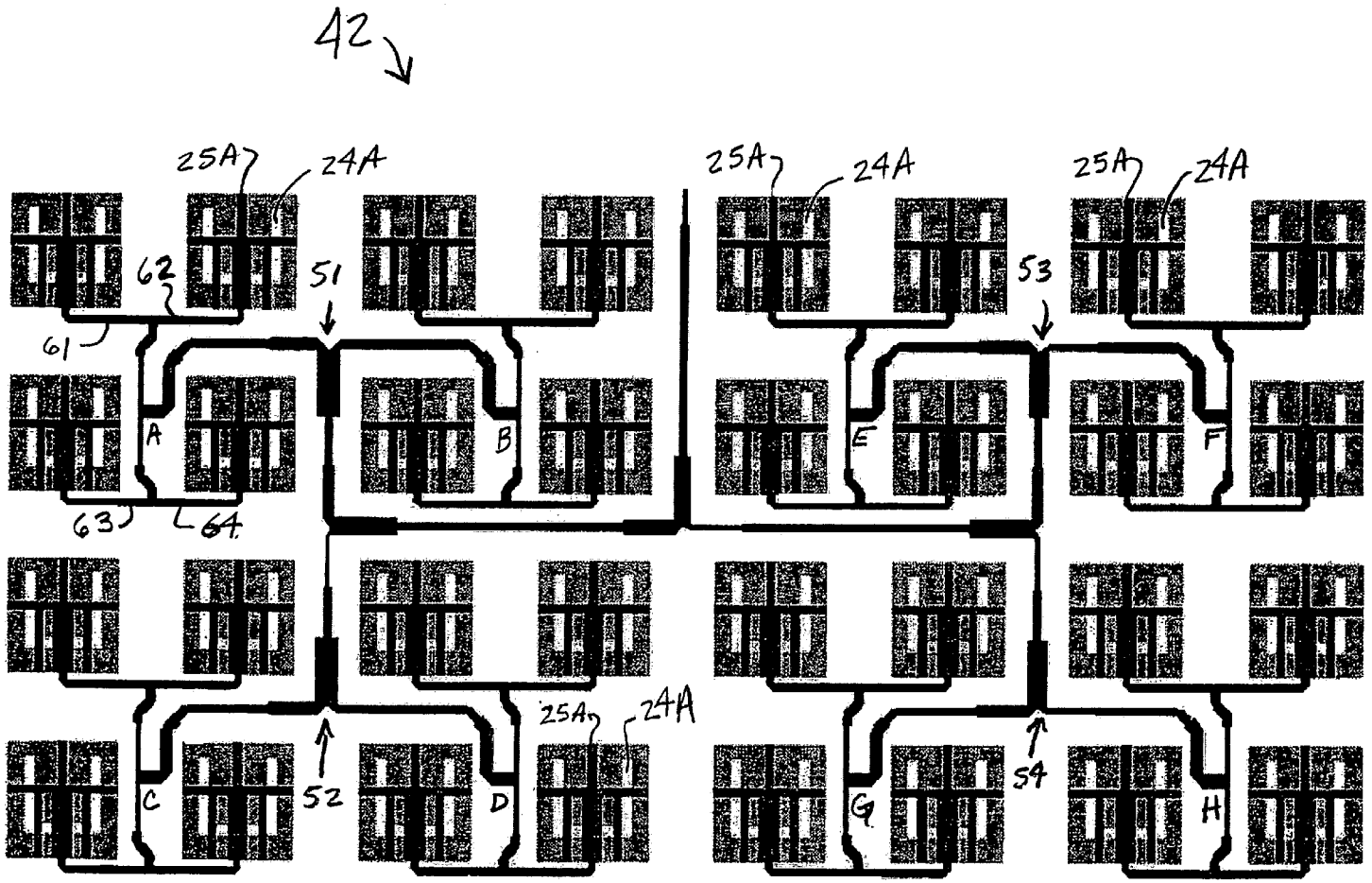
FIG. 6 illustrates a portion of the feed network of FIGS. 4 and 5 in more detail, and also illustrates the spatial relationship and corresponding proximity coupling between that portion of the feed network and the associated patch antennas in the patch layer of FIG. 2.

FIG. 4 diagrammatically illustrates exemplary embodiments of the feed network 25 of FIG. 2. FIG. 4 is a diagrammatic plan view of the feed network structure. In some embodiments, the central point 41 of feed network 25 in FIG. 4 spatially corresponds to the point of electrical connection between the feed network 25 and the SMA connector 26 of FIG. 2. In some exemplary embodiments, each of the terminal points of the FIG. 4 feed network (e.g., terminal points A–H) branches further than is illustrated in FIG. 4 to provide proximity coupling to four patch antennas of the type generally illustrated in FIG. 3. This can be seen with reference also to FIG. 6. FIG. 6 illustrates the portion 42 of the feed network of FIG. 4 in more detail, and shows that each of the eight terminal points A through H feeds four feed network portions 25A which are proximity coupled to respectively corresponding patch antennas 24A in the same general fashion as illustrated in FIG. 3.

Figure 5:
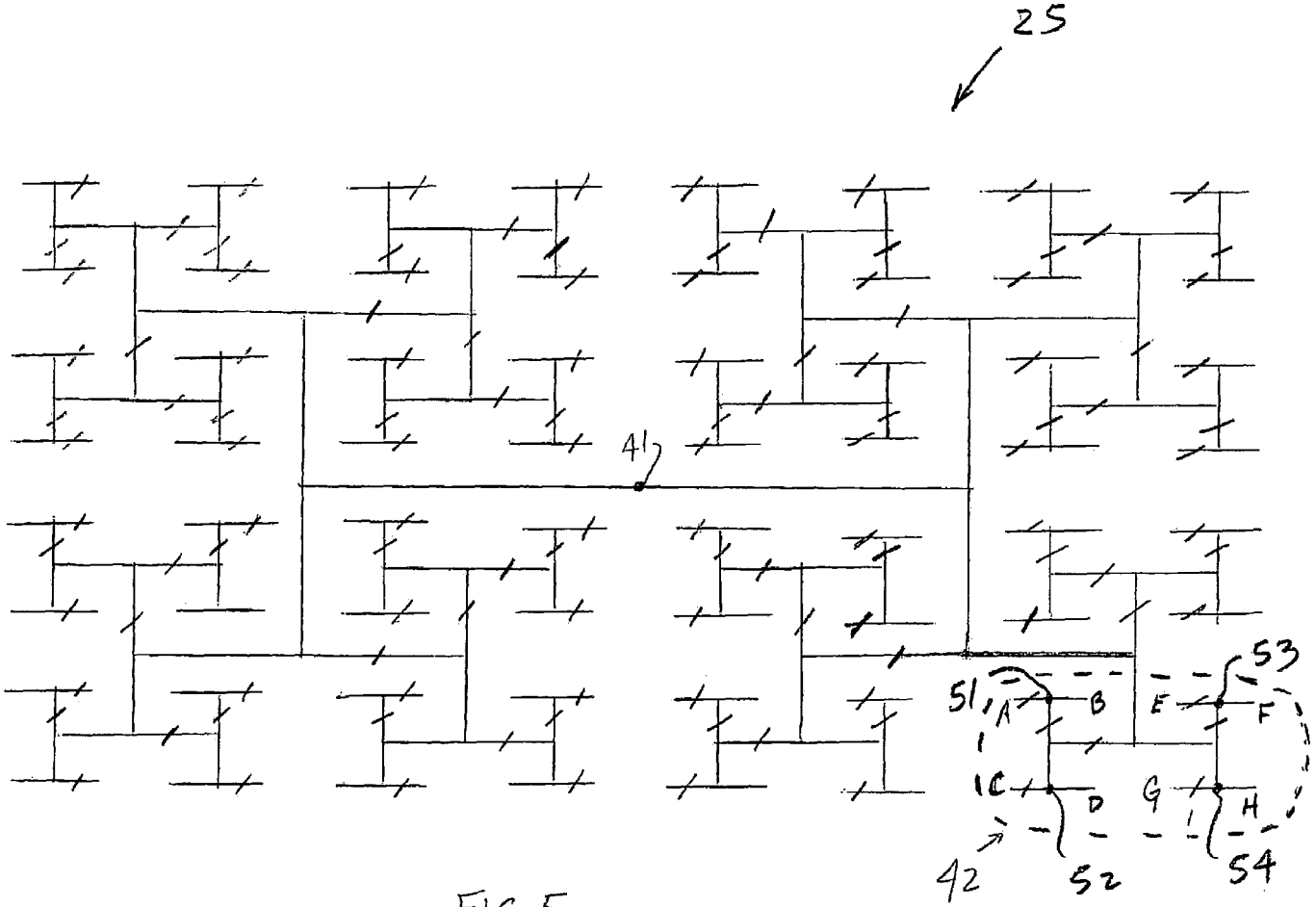
FIG. 5 diagrammatically illustrates a power distribution arrangement which produces a taper in the feed network of FIG. 4.

FIG. 5 illustrates how unequal power division can be applied within the feed network 25 of FIG. 4 in order to provide an amplitude taper across the patch antenna array aperture according to exemplary embodiment of the invention. Beginning with the central point 41 and extending outwardly downstream through the feed network 25, each of the hash marks of FIG. 5 indicates that an unequal power divider, in some exemplary embodiments a Wilkinson "Split-Tree" power divider, has been provided at the immediately preceding upstream split in the feed network, such that the feed network segment bearing the hash mark carries more power than the other corresponding un-hashed feed network segment that originates at the same split in the feed network. For example, unequal power divisions at split points 51, 52, 53 and 54 result in segments A, C, E and G carrying more power than their respectively corresponding segments B, D, F and H. In the example of FIG. 5, the unequal power dividers collectively direct more power to the center 41 of the array structure.

The amplitude tapering illustrated in FIGS. 5 and 6 can reduce the sidelobes in the antenna's gain patterns. In some exemplary embodiments, the amplitude tapering is accomplished using the Hamming weighting described above with respect to equation 1. Some embodiments are designed for use at operating frequencies in the Ku band (around 17 GHz), so the required spacing between the antenna elements in, for example, a 16×32 array, is too close to accommodate enough unequal power dividers to individually weight each antenna element. In such embodiments, each antenna element of a given 2×2 set of four antenna elements receives an equal amount of power, as divided equally four ways from a common feed point therebetween, such as point A feeding segments 61, 62, 63 and 64, and their corresponding antenna elements, equally in FIG. 6. In such embodiments, the Hamming weighting is not applied with respect to each antenna element, but rather is applied with respect to each 2×2 set of four antenna elements. So, each of the four segments 61–64 has the same Hamming weighting coefficient produced, for example, using equation 1.

FIGS. 7 and 8, taken together, illustrate exemplary Hamming weighting coefficients used for amplitude tapering in an exemplary patch antenna array embodiment having 32 columns and 16 rows (m=32 and n=16 in equation 1). FIG. 7 illustrates all 16 rows for columns 1–16, and FIG. 8 illustrates all 16 rows for columns 17–32. The center point 41 is shown in FIGS. 7 and 8 for ease of relating FIGS. 7 and 8 to one another, and for ease of comparison to FIGS. 4–6. In the example of FIGS. 7 and 8, the amplitude tapering is such that the power carried in the feed network is directed toward the center point 41. It should also be noted that individual 2×2 sets of four antenna elements all have the same corresponding Hamming weighting coefficient.

Referring again to FIG. 2, in some embodiments the substrates 21 and 23 are flexible Teflon sheets, which results in a flexible planar patch antenna array apparatus that can be readily conformed to non-planar or curved surfaces. Some embodiments use Teflon sheets that are reinforced with glass fibers for rigidity and strength.

Some exemplary embodiments are designed for an operating frequency of 16.7 GHz, and include a 16 row by 32 column array of patch antenna elements such as shown in FIG. 3, spaced from one another by 9 mm. Such embodiments have been shown to provide more than 17.6% instantaneous bandwidth, which permits the antenna array to support a four inch resolution SAR. The patch antenna array apparatus in such embodiments typically weighs less than 0.4 lbs/ft$^2$, having a length around 12 inches, a width of around 6 inches, and a thickness of approximately 53 mils. Other embodiments may have different row and/or column dimensions, and/or different operating frequencies and corresponding antenna element spacings, and/or different antenna element dimensions. The length and width dimensions of the overall patch antenna array apparatus vary according to the size of the array, the size of the individual patch antenna elements, and the antenna element spacing.

The 9 mm spacing described above is too close for unequal power dividers to be used for each patch antenna element, so these embodiments apply the aforementioned 4-way equal power division among the antenna elements of 2×2 sub-arrays, as illustrated generally in FIG. 6. In a 16×32 array of patch antenna elements, there are 128 2×2 sub-arrays arranged in a sub-array pattern of 8 rows by 16 columns.

It will be evident to workers in the art that the above-described use of photolithographic patterning and etching to produce both the patch antenna array and the feed network on a common unitary substrate provides for improved reproducibility. More specifically, and referring again to FIG. 2, once a desirable spatial relationship (and corresponding proximity coupling) between the patch antenna array structure 24 and the feed network structure 25 has been identified (for example, by comparing experimental results obtained with different spatial relationships), that desirable spatial relationship can be readily and accurately reproduced because the pair of photolithographic patterns that produces the desirable relationship can simply be applied repeatedly to the opposite sides of other substrates, thereby reproducing the desirable relationship.

As demonstrated above, exemplary embodiments of the invention provide a high-performance, light weight, wide-band, linearly-polarized, amplitude-tapered passive patch antenna array apparatus that is easily manufactured and readily reproducible.

Although exemplary embodiments of the invention have been described above in detail, this does not limit the scope of the invention, which can be practiced in a variety of embodiments.

What is claimed is:

1. A patch antenna array apparatus, comprising:

a) a unitary first dielectric substrate having a top and a bottom surface and said unitary first dielectric substrate comprises a material selected from the group consisting of Teflon and Duroid;

b) an array of feed network elements provided on said bottom surface of said first dielectric substrate;

c) an array of patch antenna elements provided on said top surface of said first dielectric substrate, wherein said array of patch antenna elements and said array of feed network elements are respectively provided on said top surface and said bottom surface of generally oppositely facing surfaces of said first dielectric substrate, and wherein each element of said array of patch antenna elements is superposed and aligned over a single element of said feed network elements; and d) a second dielectric substrate having a top and a bottom surface and said second dielectric substrate comprises a material selected from the group consisting of Teflon and Duroid, wherein no electrically conductive material is provided on said top surface of said second dielectric substrate, and wherein the top surface of said second dielectric substrate is bonded to the bottom surface of said first dielectric substrate; and e) an electrically conductive ground plane provided on said bottom surface of said second dielectric substrate.

2. The apparatus of claim 1, wherein said array of feed network elements includes a plurality of power dividers which divide power unequally to produce a taper in said feed network.

3. The apparatus of claim 2, wherein said power dividers collectively implement weighting to produce said taper in said feed network.

4. The apparatus of claim 2, wherein said array of patch antenna elements includes a plurality of groups of patch antenna elements and, within each said group, said feed network elements on said bottom of said first dielectric substrate distribute an approximately equal amount of power to each said patch antenna element of said group.

5. The apparatus of claim 1 wherein said first and said second dielectric substrates are flexible for rendering said patch antenna array apparatus conformable to a non-planar surface.

6. A method of bonding a patch antenna array apparatus, comprising:

a) interposing a dielectric material between the first and second dielectric substrates, b) pressing the said first and the said second dielectric substrates together with the said dielectric material interposed therebetween, and c) melting the said dielectric material between the said first and the said second dielectric substrates while the said first and the said second substrates are pressed together.

7. A method of reproducibly fabricating a patch antenna array apparatus, comprising:

a) providing an array of patch antenna elements on the top surface of a first dielectric substrate, wherein the said array of patch antenna elements is photolithographically patterned and etched in a first electrically conductive plating on the said top surface of the said first dielectric substrate, and b) providing an array of feed network elements on the bottom surface of said first dielectric substrate, wherein the said array of feed network elements is photolithographically patterned and etched in a second electrically conductive plating on the said bottom surface of the said first dielectric substrate.

8. The method of claim 7, including bonding the said first dielectric substrate to a second dielectric substrate to form a generally planar laminate structure.

* * * * *